MOLDING TOY

RELATED APPLICATIONS

This is a continuation-in-part of Ser. No. 395,410 filed Sept. 10, 1973 now U.S. Pat. No. 3,869,824 issued Mar. 4, 1975 for Assembly Toy & Craft as a continuation-in-part of Ser. No. 223,148 filed Feb. 3, 1972 now abandoned.

SUMMARY OF THE INVENTION

This invention relates to improvements in molding toys and crafts and articles produced therefrom.

A variety of crafts have been developed and utilized to produce articles of jewelry and artifacts which are made of different colored components such as plastic or glass chips. These articles require the matching of the colored components with cavities formed in the base on which they are applied, the special alignment of the components in the cavities and the bonding or otherwise retainment of the components against the base. Such procedures are tedius and frequently result in assemblies which may easily come apart. The instant invention comprises a structure in a mold which forms part of a finished article and which is so colored or decorated as to provide at least portions thereof representing metallic portions of the finished article.

Accordingly, it is a primary object of this invention to provide new and improved molding toys and crafts which may be utilized to produce a variety of different brightly colored articles.

Another object is to provide an improved structure in a casting mold for a molding toy which is simple and inexpensive to produce.

Another object is to provide a craft employing a plastic mold which becomes part of the finished article and contains portions thereof which are shaped and decorated to represent metallic portions of the finished article.

Another object is to provide a craft employing a mold having the general configuration of a piece of jewelry and containing compartments in which liquid molding material may be disposed and cast to shape to represent jewels or brightly colored portions of the finished article.

Another object is to provide a mold for use in a craft and toy which is in the configuration of a finger ring or bracelet.

With the above and other such objects in view as may hereafter more fully appear, the invention consists of the novel constructions and combinations of parts set forth in the following specification and accompanying drawings but it is to be understood that changes and modifications may be resorted to which come within the purview of the invention as claimed without departing from the spirit and nature of the invention.

In the drawings:

FIG. 1 is a plan view of an assembly toy or craft which is partially completed and shows various features of the instant invention including a substrate in the form of a plaque containing decorative elements secured thereto;

FIG. 2 is a plan view of a fragment of a modified form of the plaque of FIG. 1 showing certain surface decorating elements secured thereto;

FIG. 3 is a plan view of a fragment of the plaque of FIG. 2 showing other types of surface decorating elements secured thereto;

FIG. 4 is a plan view of a fragment of a plurality of surface decorating elements and a frame retaining same in edgewise abutment as applicable to the plaque of FIG. 1;

FIG. 5 is a plan view of a cluster of three surface decorating elements formed together and applicable as a surface decorating element for a constructional plaque of the type shown in FIG. 1;

FIG. 6 is a plan view of another form of decorating element comprising a cluster of seven rings formed into an integral molding and applicable to the decorating plaque craft of FIG. 1;

FIG. 7 is a plan view of another form of decorating element comprising a cluster of nine rings formed together of a single molding and applicable to the plaque craft structure of FIG. 1;

FIG. 8 is a plan view of a fragment of the board of FIGS. 2 and 3 showing modified form of surface decorating element frictionally assembled therewith.

FIG. 9 is a plan view of a circular array of ring-shaped decorations which are integrally molded in a ring-shaped cluster and applicable to the plaque craft of FIG. 1;

FIG. 10 is a plan view of a fragment of a board of the type shown in FIG. 2, showing various elements frictionally assembled thereto;

FIG. 11 is an edge view in cross section of a board of the type shown in FIG. 10 showing one of the surface decorating elements frictionally secured thereto;

FIG. 12 is an end view of the board of FIG. 1 showing surface decorating elements in stacked assembly thereon;

FIG. 13 is a plan view of a modified form of surface decorating element in the form of a hollow rectangle;

FIG. 14 is a plan view of a modified form of surface decorating element in the shape of a hollow triangle;

FIG. 15 is a plan view of a modified form of surface decorating element in the form of a plurality of integrally moled hollow triangles;

FIG. 16 is a plan view of a modified form of surface decorating element in the shape of a hollow hexagonal shaped element;

FIG. 17 is a plan view of a cluster of spherical or short cylindrical elements applicable for forming surface decorations of the type showin in FIG. 1; and FIG. 18 is a plan view of yet another form of surface decorating element which is designed to edgewise nest with similar elements to decorate a surface therewith.

FIG. 19 is a face view of a modified form of the assembly toy and craft illustrated in FIG. 1.

FIG. 20 is a fragmentary view in cross-section of one construction of the baseboard employed in the embodiment of FIG. 19.

FIG. 21 is a fragmentary view in cross-section of another form of the construction of the structure of FIG. 19.

FIG. 22 is yet another form of construction of the structure shown in FIG. 19 and is also illustrated in fragmentary cross-section.

In FIG. 1 is shown an art assembly toy 10 composed of a base sheet 11 made of paper, paperboard, plastic or metal or a laminate of such materials. The base sheet 11 may also contain flocking on its outer surface 12 against which outer surface a plurality of art components may be secured to form pictures, collages or the like.

Shown printed on the outer surface 12 of sheet 11 are a plurality of outlines 13 defining borders within which

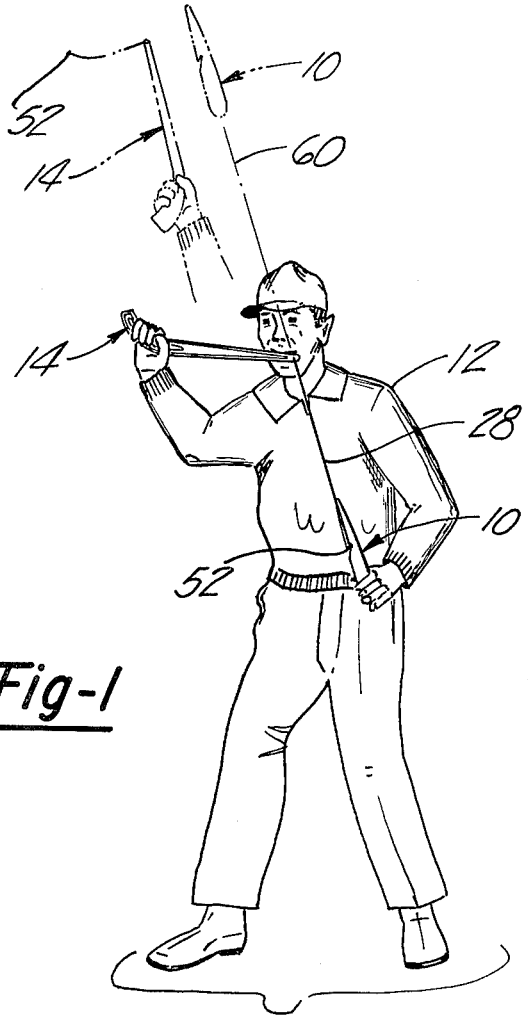
Fig-1
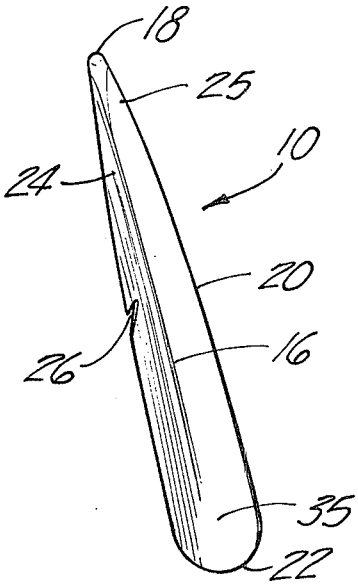
Fig-2
Fig. 3
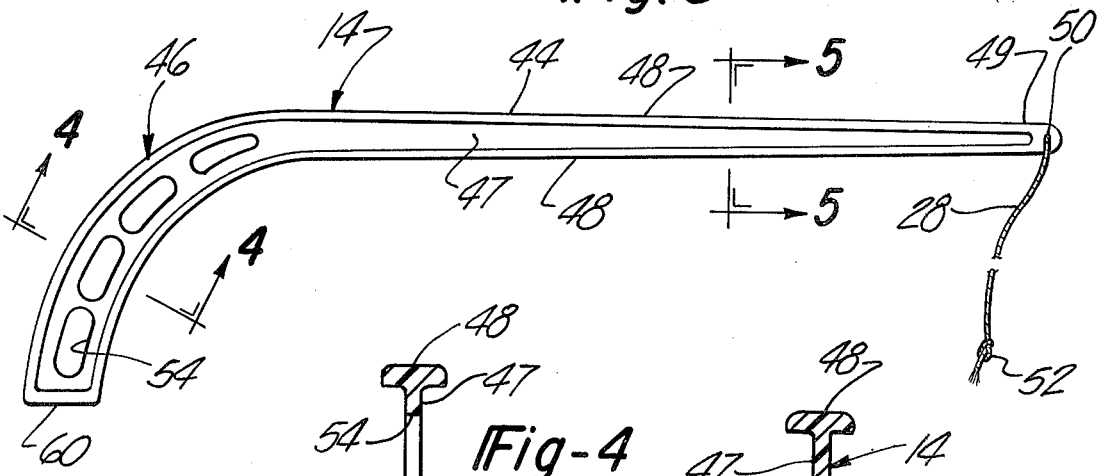
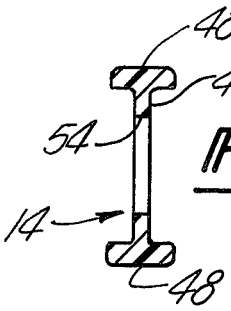
Fig-4
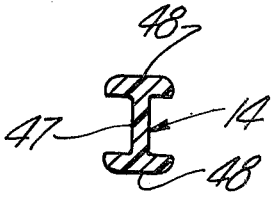
Fig-5

AIRFOIL AND MEANS FOR LAUNCHING SAME

BACKGROUND OF THE INVENTION

1. Field of the Invention

The present invention relates to aerial devices and, in particular, to devices having flight characteristics which permit the device to be propelled vertically into the air to a minimum speed upon which reducing to such speed will descend to the ground in a spinning motion for a soft landing.

2. Description of the Prior Art

Heretofore, aerial devices and apparatus for launching such devices have been disclosed, and examples of such devices and apparatus are illustrated in U.S. Pat. Nos. 913,381, 2,257,971, 2,750,711, 3,353,295, 3,375,606, 3,662,730 and British Patent No. 641,589. In order for a device of the type described herein to be of commercial value it must have several characteristics which insure that the device will function in the desired manner each time it is employed. It is envisioned that the present invention will be utilized as a toy and as such, it is essential that the aerial device be reliable in that after each time it is launched and accelerated upwardly, the device must achieve the spinning mode; that is, it must descend slowly to insure a safe descent as a rapid descent along its longitudinal axis could result in an injury to the person using the device or to other persons nearby. To that end, it is necessary that the device be so designed that it may be mass produced, but with the characteristics of the device being such that repeatability of performance is achieved with each such mass produced device. Keeping in mind that the present invention is particularly adapted for use as an aerial toy, it is necessary to provide a launcher for such an airfoil which may be simply and easily used by a youngster to launch the device with sufficient velocity that the device will rise to a desired vertical altitude, yet one which does not employ rubber bands and other elastic materials as such materials could be used improperly in such a manner as to present a hazard to those nearby.

The characteristics as set forth hereinabove are not employed or otherwise incorporated in any of the airfoils and/or launchers disclosed in the aforementioned United States and foreign patents.

SUMMARY OF THE INVENTION

The present invention, which will be described subsequently herein in greater detail, comprises an airfoil and a launcher for propelling the airfoil in a manner which initially approximates the flight of a rocket or arrow until the airfoil reaches a minimum speed, whereupon, the airfoil will achieve a spinning motion which provides for a slow descent and soft landing. The airfoil is a static element requiring no moving parts. The change in motion is achieved without assistance while at the same time means are provided for constantly rotating the airfoil about its longitudinal axis to provide for stability and control of movement.

It is therefore an object of the present invention to provide an airfoil having improved flight characteristics and performances above and beyond the type disclosed in the aforementioned patents, with such device being mechanically propelled to a vertical altitude at which point the device will descend at a slower rate.

It is yet another object of the present invention to provide such an airfoil which may be fabricated at a low cost with no moving parts, and which is of such a design that it incorporates the aforementioned flight characteristics to permit the same to be propelled to high altitudes while descending at a low rate of descent and one which may be mass produced, yet each mass produced item will perform the desired function.

Other objects, advantages and applications of the present invention will become apparent to those skilled in the art of airfoils and launchers for propelling such airfoils when the following example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and in which:

FIG. 1 is a perspective view of an aerial toy constructed in accordance with the principles of the present invention and illustrating the start of the first step for launching the airfoil;

FIG. 2 is an enlarged perspective view of the airfoil illustrated in FIG. 1;

FIG. 3 is a side elevational view of the launcher utilized for launching the airfoil illustrated in FIG. 1;

FIG. 4 is a cross-sectional view of the launcher taken along line 4—4 of FIG. 3;

FIG. 5 is a cross-sectional view of the launcher taken along lines 5—5 of FIG. 3;

DESCRIPTION OF THE PREFERRED EMBODIMENTS

Figures 6, 7, 8, 9, 10, 11, 12, 13:
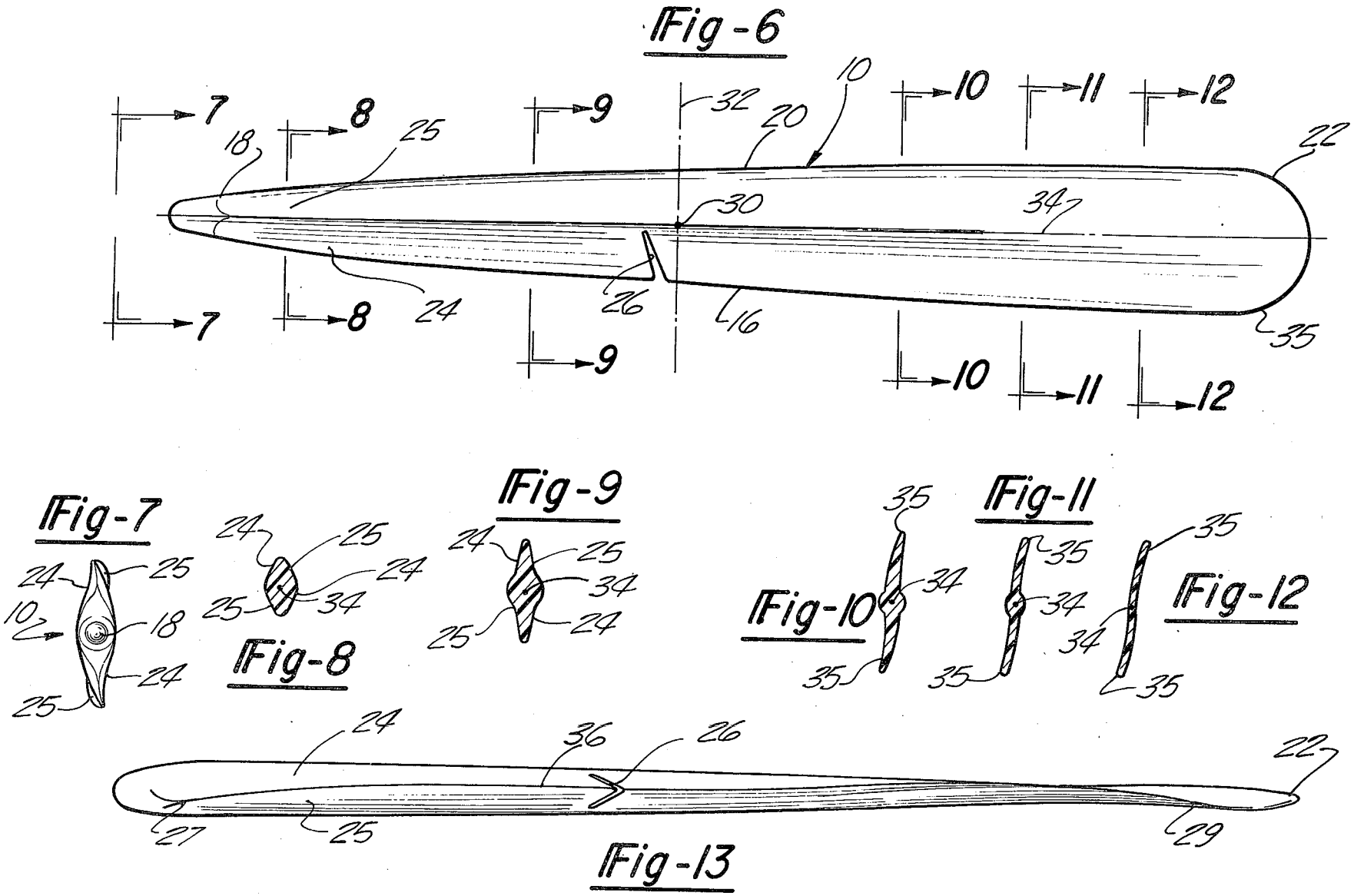
FIG. 6 is a side elevational view of the airfoil illustrated in FIGS. 1 and 2.
FIG. 7 is a front-end view of the airfoil as seen from line 7—7 of FIG. 6.
FIG. 8 is a cross-sectional view of the airfoil taken along line 8—8 of FIG. 6.
FIG. 9 is a cross-sectional view of the airfoil taken along line 9—9 of FIG. 6.
FIG. 10 is a cross-sectional view of the airfoil taken along line 10—10 of FIG. 6.
FIG. 11 is a cross-sectional view of the airfoil taken along line 11—11 of FIG. 6.
FIG. 12 is a cross-sectional view of the airfoil taken along line 12—12 of FIG. 6.
FIG. 13 is a fragmentary top elevational view of the airfoil illustrated in FIG. 6.

Referring now to the drawings and, in particular, to FIG. 1 wherein there is illustrated one example of the present invention in the form of an airfoil 10 which is launched by a user 12 utilizing a launcher 14, all of which will be described in greater detail hereinafter. As can best be seen in FIGS. 2 and 6 through 13, the airfoil 10 comprises an elongated body or member 16 having a nose portion 18, a mid-section 20 and a trailing edge portion 22. In the preferred embodiment the airfoil 10 is fabricated from a material which is lightweight and preferably has a specific gravity comparable to cedar wood with the overall weight being approximately one-half to three-fourth of an ounce. Preferably the airfoil 10 has an overall length of 13 ¾ inches with the trailing edge portion 22 having a width of approximately 1 ¾ to 1 ⅞ inches while the width of the airfoil tapers gradually toward the nose portion 18 to a width of 1 ¼ inches, whereupon the shape of the airfoil at the nose portion 18 assumes a sharper taper and a round cross section as more clearly seen in FIGS. 7 and 8.

The airfoil 10 is provided with a plurality of accurately spaced, dual flight control surfaces 24 and lateral control surfaces 25 which extend from the nose portion 18 rearwardly along the full longitudinal length of the elongated member 16. The dual flight control surfaces 24 function to provide stability to the airfoil 10 after it has been launched by the launcher 14 and is being propelled vertically upwardly above the minimum spin velocity. The air flowing by the flight control surfaces 24 operate to maintain the airfoil 10 in a straight flight similar to the flight of an arrow. The dual lateral control surfaces 25 are, in fact, unstable surfaces which induce a spinning effect on the airfoil 10 as will be described hereinafter.

As can best be seen in FIG. 6, the airfoil mid-section 20 is provided with an inclined slot 26 which defines a launch hook adapted to be engaged by one end of a cable 28 (FIG. 3) carried by the launcher 14 for purposes of launching the airfoil 10 in a manner which will be described in greater detail hereinafter. As can best be seen in FIG. 6, the launch hook 26 is inclined toward the nose portion 18 and extends approximately half of the width of the elongated member 16. Of significant importance is the fact that the launch hook 26 is disposed at a point between the nose portion 18 and the center of gravity 30 and, preferably, approximately one-half inch ahead of the center of gravity 30.

The airfoil 10 is adapted to rotate about the longitudinal axis 34 of the elongated member 16 during both the launching and descent phases of the flight of the airfoil 10. This rotational movement of the airfoil 10 about its longitudinal axis 34 is induced by the passage of air over the longitudinal rotating control surfaces 35 which are formed by the curved trailing edge portion 22 and are clearly illustrated in FIGS. 11 and 12.

After the airfoil 10 is propelled vertically, upwardly by means of the launcher 14, the airfoil 10 will begin to also rotate about its center of gravity 30 along a lateral axis 32 (FIG. 6) resulting in the airfoil descending to the ground at a slow rate. The passage of air across lateral control surfaces 25 provides the necessary force to produce the aforementioned pinwheeling effect, that is, the rotation of the airfoil 10 about its center of gravity 30 along the lateral axis 32 after the velocity of the airfoil has been reduced and descent of the airfoil commences. As can best be seen in FIG. 13, the lateral control surface 25 is in the form of a curved surface having an edge 36 and extending the last two-thirds of the length of the airfoil 10. In the present example the curved edge commences at a point near the nose on one side of center (see 27 in FIG. 13) and extends uniformly for approximately 10 ¾ inches terminating at approximately the same point (29) at the rear end.

It can thus be seen that the airfoil 10 is provided with three control surfaces, each of which functions independently to produce a particular flight characteristic for the airfoil 10. The nose portion 18 is provided with the dual longitudinal flight control surfaces 24 that provide in-flight stability for the airfoil 10 during its ascent. The trailing edge portion 22 is provided with the longitudinal rotating control surfaces 35 which function to induce rotation of the airfoil 10 about its longitudinal axis 34 during all phases of flight of the airfoil 10. The dual lateral rotating control surfaces 25 function to induce the rotational movement of the airfoil about its lateral axis 32, and thus, provide the pinwheeling effect of the airfoil 10 to insure a slow descent which in conjunction with the blunt nose portion 18 represents a substantial safety factor in the use of the airfoil 10. It should also be noted that the trailing edge portion 22 is tapered for approximately the last third of its length (FIG. 6), that is, approximately 2 ½ inches at the trailing edge portion 22 tapers inwardly towards the longitudinal axis 32.

Referring now to FIGS. 1 and 3 through 5 wherein the launcher 14 is illustrated as comprising an elongated member 44 having an I-beam shaped cross section and a curved handle 46 at one end. The member 44 is defined by a web 47 enclosed by flanges 48 extending from the handle 46 in a tapered fashion towards the cable end 49 which, in turn, is provided with an aperture 50 for securing one end of the launch cable 28. The other end of the launch cable 28 is knotted at 52 for purposes of engaging the slot 26 that defines the launch hook on the airfoil 10 (FIG. 1). The web 47 of the elongated member 44 provides the required rigidity for the launcher 14 while apertures 54 disposed along the curved handle 46 facilitate grasping of the launcher 14 by the user 12. It can be seen that the curved handle 46 is so designed as to facilitate grasping of the launcher 14 at any desired point. The grasping of the launcher 14 at a point closest to the handle end 60 provides the user 12 with a greater ability to twist the launcher 14 from a horizontal position as shown in FIG. 1 to the vertical position shown in phantom lines in FIG. 1. It also facilitates the use of a single launcher 14 by either adults or children depending upon where they need to grasp the handle 46 for purposes of launching the airfoil 10.

In use, the user 12 grasps the handle 46 of the launcher 14 with one hand while the knotted end 52 of the cable 28 is engaged with the launch hook 26 on the airfoil 10 in the manner illustrated in FIG. 1. The airfoil 10 is grasped with the user's other hand at the trailing edge portion 22 whereupon the user 12 raises his launch holding arm upwardly such that the nose portion 18 of the airfoil 10 and its longitudinal axis 34 are maintained along a straight line launch path as shown by the dotted line 60 in FIG. 1 until the user's arm is outstretched. Simultaneously a twisting motion of the wrist will propel the airfoil 10 along the launch path 60 to a desired vertical height. During launch the longitudinal flight control surfaces 24 function in the aforementioned manner to provide stability to the airfoil 10 while the longitudinal rotating control surfaces 35 induce rotational movement of the airfoil about its longitudinal axis 34. Upon reaching the apex of its flight, the dual lateral rotating control surfaces 25 will induce the pinwheeling effect; that is, the surfaces 25 will cause the airfoil 10 to rotate about its lateral axis 32 such that it will descend in a slow manner. At the same time the airfoil 10 will continue to rotate about its longitudinal axis 34, as aforementioned.

In summary such an elongated member may be launched as described, propelled by its own power source, as a rocket, or towed by an external power source. An arrow-like flight will persist until velocity slows to below a certain speed. The nose configuration and overall length and shape provide stability in an arrow-like flight path.

The lateral flight surface 25 causes the elongated member to become unstable in arrow-like flight below a certain velocity and helps induce rotation on the long axis. At this reduced speed, the full curvature of edge 36 causes the part to rotate persistently on its long axis.

This makes possible a soft landing without internal or external controls other than the reduction in speed (no movable parts are required).

In larger configurations, the rounded center section of the fuselage would carry the payload. A tubular shaped rocket motor or motors could be mounted behind point 30. Propulsion could be one or two stages or sustained still retaining the automatic soft landing feature while a propeller like configuration at the rear caused rotation on the short axis.

Heights of 100 feet are easily attained, and a 250 foot vertical flight is possible. The elongated member may be launched at various vertical angles with most satisfactory results achieved by launching into the wind or with the prevailing wind. When launched against the wind, the elongated member will return toward the launching point. When launched with the wind, the elongated member may easily travel considerable distances ranging upward from 200 feet to as much as 100 or 200 yards.

The handle of the launcher is designed to "cock" or twist the wrist of the user. The elongated member must be started on a straight line, but maximum loft is attained by "flipping" the wrist near the end of the launch process. Maximum elevation is attained by grasping the end of the handle.

It is preferred that the present invention be fabricated from a lightweight molded plastic material which is of an adequate and desirable rigidity.

It can thus be seen that the present invention has provided a new and improved airfoil and launcher for propelling the same to a vertical altitude, and it should be understood by those skilled in the art of such airfoils and launchers that other forms may be had all coming within the spirit of the present invention and the scope of the appended claims.

What is claimed is as follows:

1. An airfoil adapted to be propelled through the atmosphere, said airfoil comprising an elongated member having a tapered nose portion; first surface means extending from said nose portion and functioning to stabilize said airfoil during a first stage of flight, said first surface means being operable beyond a predetermined velocity; second surface means extending from said nose portion and functioning to rotate said airfoil about its center of gravity along an axis which is traversing the longitudinal axis of said elongated member when the velocity of said airfoil is below a predetermined rate.

2. The airfoil defined in claim 1 further comprising a third surface means for rotating said elongated member about its longitudinal axis.

3. The airfoil defined in claim 2 further comprising a slotted portion extending in from an edge of said elongated member, said slotted portion being inclined with respect to the longitudinal axis of said elongated member and disposed a predetermined distance from the center of gravity of said member toward said nose portion.

4. The airfoil defined in claim 3 further comprising means engaging said sliding portion for propelling said airfoil elongated member into said atmosphere at a velocity sufficient to cause said elongated member to rotate about said longitudinal axis while not rotating about said transverse axis after the velocity of said airfoil drops below a predetermined amount.

5. The airfoil defined in claim 1 wherein said elongated member is fabricated from a lightweight material.

6. The airfoil defined in claim 1 wherein the nose portion of said elongated member is thicker than the remainder of said elongated member, said elongated member being relatively thin in one plane.

7. The airfoil defined in claim 1 wherein said first surface means comprises a plurality of circumventially spaced longitudinally disposed surfaces extending from said nose portion for providing increased stability to said airfoil as the same is being propelled in a vertical altitude; said second surface means comprising a longitudinally curved edge portion of said elongated member operable upon reaching a predetermined reduced velocity functioning to cause said airfoil member to spin about an axis traversing said longitudinal axis such that said airfoil will descend at a substantially reduced velocity.

8. The airfoil defined in claim 1 wherein said nose portion is blunt and has a rounded cross section which tapers outwardly with respect to said nose to a predetermined point whereupon the edge portion of said elongated member is curved with respect to longitudinal axis of said elongated member, said curved edge portion of said elongated member commencing at a point between said nose portion and the center of gravity of said member.

9. The airfoil defined in claim 2 further comprising means for launching said airfoil, said means comprising an elongated member having a handle curved along the predetermined path adapted to be grasped by the user of said launcher, the point at which said curved handle is grasped functioning to control the rate at which said airfoil is launched; and cable means carried at the end of said launcher opposite said handle means, said cable being attachable to said slotted portion of the elongated member for launching said elongated member.

10. The airfoil defined in claim 9 wherein said launcher comprises an elongated member having an I-beam cross section tapering to a smaller cross section toward said aperture on which said cable is mounted.

* * * * *